US010092148B2

(12) United States Patent
Gierer et al.

(10) Patent No.: US 10,092,148 B2
(45) Date of Patent: Oct. 9, 2018

(54) VACUUM BYPASS VENT AND VACUUMS INCORPORATING SUCH BYPASS VENTS

(71) Applicant: Emerson Electric Co., St. Louis, MO (US)

(72) Inventors: Joseph T. Gierer, Glen Carbon, IL (US); Jeffrey L. Young, St. Peters, MO (US); David Beth, St. Charles, MO (US)

(73) Assignee: Emerson Electric Co., St. Louis, MO (US)

( * ) Notice: Subject to any disclaimer, the term of this patent is extended or adjusted under 35 U.S.C. 154(b) by 901 days.

(21) Appl. No.: 14/196,103

(22) Filed: Mar. 4, 2014

(65) Prior Publication Data

US 2014/0182078 A1 Jul. 3, 2014

Related U.S. Application Data

(62) Division of application No. 12/651,243, filed on Dec. 31, 2009, now abandoned.

(60) Provisional application No. 61/142,138, filed on Dec. 31, 2008.

(51) Int. Cl.

| | |
|---|---|
| ***A47L 7/00*** | (2006.01) |
| ***A47L 9/00*** | (2006.01) |
| ***A47L 5/22*** | (2006.01) |

(52) U.S. Cl.

CPC ..... *A47L 7/0004* (2013.01); *A47L 5/22* (2013.01); *A47L 7/0028* (2013.01); *A47L 7/0042* (2013.01); *A47L 9/0072* (2013.01)

(58) Field of Classification Search

CPC ..... A47L 7/0023; A47L 7/0004; A47L 7/0028

USPC ..... 15/327.1, 421

See application file for complete search history.

(56) References Cited

U.S. PATENT DOCUMENTS

| | | | |
|---|---|---|---|
| 2,230,113 | A | 1/1941 | Hein |
| 2,758,670 | A | 8/1956 | Doughman et al. |
| 2,764,256 | A | 9/1956 | Allen |
| 2,814,358 | A | 11/1957 | Beede et al. |
| 2,817,414 | A | 12/1957 | Ferraris |
| 2,863,524 | A | 12/1958 | Buda |
| 3,138,873 | A | 6/1964 | Bishop |
| 3,172,743 | A | 3/1965 | Kowalewski |
| 3,220,638 | A | 11/1965 | Peterson |
| 3,290,865 | A | 12/1966 | Serou et al. |
| 3,296,777 | A | 1/1967 | Jackson et al. |
| 3,626,545 | A | 12/1971 | Sparrow |

(Continued)

*Primary Examiner* — Michael Jennings

(74) *Attorney, Agent, or Firm* — Armstrong Teasdale LLP

(57) ABSTRACT

A vacuum appliance capable of picking up both wet and dry material is described, wherein the vacuum appliance includes an impeller configured to induce liquid into the vacuum appliance, a motor configured to turn the impeller, a restrictor assembly to prevent the liquid from being ingested into the motor, and a bypass vent assembly configured to allow sufficient air to reach the motor in order to keep the motor cool while the restrictor is preventing the liquid from being ingested into the motor. The vacuum appliance also includes a drum configured to retain the liquid and an impeller intake between the impeller and the drum. The restrictor may comprise a float configured to rise with a level of the liquid in the drum and prevent the liquid from entering the impeller intake. The bypass vent assembly may be configured to allow airflow to bypass the restrictor and/or the drum.

43 Claims, 12 Drawing Sheets

(56) References Cited

U.S. PATENT DOCUMENTS 3,870,486 A 3/1975 Eriksson et al.
3,909,219 A * 9/1975 Fromknecht ..... A47L 7/0028 55/378
4,057,364 A 11/1977 Bratschitsch
4,185,974 A * 1/1980 Hiester ..... A47L 7/0028 15/327.6
4,246,676 A 1/1981 Hallsworth et al.
4,294,595 A 10/1981 Bowerman
4,508,550 A * 4/1985 Berfield ..... A47L 7/0028 137/202
4,623,366 A 11/1986 Berfield et al.
4,797,072 A 1/1989 Berfield et al.
5,062,870 A 11/1991 Dyson
5,618,410 A * 4/1997 Wallace ..... A47L 7/0028 137/398
5,920,955 A * 7/1999 Berfield ..... A47L 7/0028 15/321
5,954,863 A * 9/1999 Loveless ..... A47L 5/365 15/353
6,011,331 A 1/2000 Gierer et al.
6,101,669 A * 8/2000 Martin ..... A47L 5/24 15/327.2
6,110,248 A * 8/2000 Liu ..... A47L 9/127 55/385.1
6,113,663 A * 9/2000 Liu ..... A47L 5/365 55/459.1
6,115,881 A * 9/2000 Hult ..... A47L 9/242 15/327.1
6,167,586 B1 * 1/2001 Reed, Jr. ..... A47L 5/28 137/614.2
6,237,187 B1 5/2001 Hult et al.
6,279,198 B1 8/2001 Martin et al.
6,324,723 B1 * 12/2001 Dodson ..... A47L 7/0009 15/347
6,347,429 B1 2/2002 Hult et al.
6,370,730 B1 4/2002 Young et al.
6,378,165 B1 4/2002 Holsten et al.
6,440,191 B1 * 8/2002 Berfield ..... A47L 5/365 15/353
6,543,085 B2 4/2003 Holsten et al.
6,691,396 B2 2/2004 Martin et al.
7,134,694 B2 11/2006 Young et al.
7,228,592 B2 6/2007 Hawkins et al.
7,287,301 B2 * 10/2007 Marshall ..... A47L 5/225 15/327.6
7,291,195 B2 * 11/2007 Gierer ..... A47L 9/127 55/467
7,374,594 B2 5/2008 Gierer
7,374,595 B2 * 5/2008 Gierer ..... A47L 9/127 55/498
7,971,314 B2 * 7/2011 Hollis ..... A47L 5/365 15/327.1
2003/0046790 A1 * 3/2003 Crevling, Jr. ..... A47L 7/0028 15/353
2004/0111825 A1 * 6/2004 Kaufman ..... A47L 5/365 15/353

* cited by examiner

VACUUM BYPASS VENT AND VACUUMS INCORPORATING SUCH BYPASS VENTS

CROSS REFERENCE TO RELATED APPLICATIONS

The present application claims priority to U.S. Provisional Patent Application Ser. No. 61/142,138, filed Dec. 31, 2008, and U.S. patent application Ser. No. 12/651,243, filed Dec. 31, 2009, the contents of all of which are incorporated herein by specific reference in their entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to wet/dry vacuum appliances, and more specifically, are related to a bypass vent system for use with wet/dry vacuum appliances.

Description of the Related Art

Vacuum appliances capable of picking up both wet and dry materials, commonly referred to as wet/dry vacuums, are generally well-known. Such vacuums with both wet and dry capabilities are often used in workshops, basements, garages, and other environments where both wet and dry debris can accumulate and needs to be collected for separate disposal.

Wet/dry vacuums conventionally consist of a collection tank or canister, sometimes mounted on wheels or casters, and a cover or lid upon which a motor and impeller assembly is mounted. The motor and impeller assembly creates a suction within the canister, such that debris and liquid are drawn in to the canister through an air inlet to which a flexible hose can be attached. A filter within the canister prevents incoming debris from escaping from the canister while allowing filtered air to escape. One example of such an exemplary wet/dry vacuum is shown in U.S. Pat. No. 4,797,072.

In the usual canister- or tank-type vacuum cleaners that are used for collecting various types of material, they are sometimes used for collecting water or other liquid debris. In a typical vacuum cleaner of this type, the vacuum cleaner motor is supported on a removable lid for the debris collection drum and drives an impeller fan having an inlet side that communicates with the drum interior and draws a vacuum therein, allowing water or liquid debris to be drawn into the collection drum by way of a vacuum hose or the like.

In the usual canister vacuum cleaner, the lid is a generally flat surface disc or plate. To provide the lid with the strength needed for supporting the motor, especially while it is in operation, and for supporting an air filter assembly, the lid is typically formed of a strong, relatively rigid polymer or metal disc having a periphery that is shaped to sealingly engage the upper end of the side wall of the cylindrical tank or drum. A hole is cut through the lid just beneath the mounting for the motor and this hole provides communication between the interior of the tank and the impeller fan driven by the motor.

A filter assembly is interposed between the interior of the tank and the inlet to the impeller fan for capturing particulate matter so that it does not escape into and past the fan and is not expelled from the vacuum cleaner. In the typical tank vacuum cleaner, directly beneath the lid of the tank and at the inlet to the impeller fan, there is a support for a replaceable filter element. Typically, the filter support is in the form of a generally cylindrical cage, and the filter element is in the form of a cylindrical annulus or sleeve of open cell foam material which is removably fitted over the filter cage. The annular sides of the filter cage are defined by vertical ribs, shaped and placed to support the surrounding filter element, yet spaced apart so as not to interfere with air flow. The bottom of the filter cage is closed off.

In situations where liquid or wet materials are being collected, it is necessary that the flow out of the tank and into the vacuum cleaner motor be halted before the liquid or wet material is drawn into the motor. This is typically effected by way of a float element located within a filter cage assembly. The filter cage of the typical canister vacuum cleaner is secured to the underside of the lid around the hole through the lid, and is included for the purpose of supporting a cylindrically-shaped filter element. Typically, the filter cage is a molded plastic unit with an annular collar at its upper edge, and may be of cylindrical, oval, or numerous other shapes, as appropriate. Inside the filter cage, there is a ball or cylinder float element that sits on the base of the filter cage and is adapted to float up within the filter cage once the level of liquid in the tank rises above the bottom of the filter cage. The float element eventually floats high enough to seal the inlet to the impeller fan. Further operation of the vacuum cleaner is blocked until the tank is emptied of collected material. At the same time, the filter element may also be replaced if so desired by the user.

The prior art has described various types of devices that automatically indicate when the debris or liquid level in a vacuum cleaner has reached a critical level, thereby alerting the operator of the problem so that operation of the vacuum may be stopped, and the canister emptied. At that point, continued operation of the vacuum cleaner will result in ineffective or inefficient cleaning, or even worse, it may cause damage to the motor and fan unit. Illustrative patents describing such approaches include U.S. Pat. No. 2,230,113 to Hein; U.S. Pat. No. 2,758,670 to Doughman et al; U.S. Pat. No. 2,764,256 to Allen; U.S. Pat. No. 2,814,358 to Beede et al; U.S. Pat. No. 2,817,414 to Ferraris; U.S. Pat. No. 2,863,524 to Buda; U.S. Pat. No. 3,172,743 to Kowalewski; U.S. Pat. No. 3,626,545 to Sparrow; U.S. Pat. No. 3,870,486 to Eriksson et al; U.S. Pat. No. 4,246,676 to Hallsworth et al; U.S. Pat. No. 4,294,595 to Bowerman; and U.S. Pat. No. 4,623,366 to Berfield et al.

The prior art vacuum cleaner dirt level detection devices can be divided into two general categories. These devices have either floats that are designed to operate in vacuum cleaners which pick up liquids, or they have diaphragm devices that are affected by the difference in pressure between two points in the vacuum cleaner caused by the clogging of a vacuum cleaner dirt collecting bag. When the pressure differential reaches a threshold, the diaphragm triggers a sequence of mechanical or electrical steps which result in either the dust bag cover opening, a light or audible signal warning the operator to shut down the vacuum cleaner, or automatic powering down of the motor fan unit. U.S. Pat. No. 4,623,366 to Berfield is representative of the devices having a float-based system. The float devices rely generally on the principle of buoyancy which causes a float to rise and seal against a seat when a sufficient amount of water has accumulated in the collection container of the vacuum cleaner. The float blocks the fan inlet opening so that even if the motor fan unit continues to run, additional water is not pulled into the system. These float devices are thus not designed to operate by sensing a differential air pressure on opposed sides of a valve.

U.S. Pat. No. 2,817,414 to Ferraris is a typical vacuum cleaner employing a differential pressure diaphragm, or sensor, which acts to detect an increase in pressure between two points in the vacuum cleaner. In the Ferraris device, pressure readings are taken between the inside and the outside of a dust collecting bag. As the bag fills with dirt, a differential force is exerted upon a control diaphragm. At a predetermined threshold, the diaphragm distorts and sets in motion a sequence of pneumatic, mechanical and/or electrical steps which de-energize the motor fan unit. These latter type of control devices, while addressing the issue, are both complicated and expensive to manufacture.

As shown in U.S. Pat. No. 4,185,974, a canister- or tank-type vacuum cleaner which uses a generally cylindrical filter element that is fitted around a generally cylindrical filter cage is described, wherein the cage is an integral plastic molding with the lid that closes the tank of the vacuum cleaner; the vacuum cleaner motor sits atop the lid; the lid is removably sealed to the canister; and, inside the filter cage, there is a freely floating ball, which floats up through the cage as the tank becomes filled to seal the air outlet to the motor. The bottom end of the filter cage is closed off by a bottom cover. An inlet grid element, including a grid covered opening, is disposed across the hole through the tank lid for permitting air to pass through the hole in the lid while also enclosing the top end of the filter cage as a safety feature to block access to the rotating impeller fan. A generally flat wall extends from the grid to the tank lid. The bottom edge of a sleeve extending downward from the grid constitutes a seat against which the float seals upon rising to a predetermined level. If the fan continues to operate after its inlet is blocked by sealing of the float against the seat, the fan motor overheats. This causes the molded plastic grid unit to overheat at a time when there is an upward force transmitted through the float to the sleeve portion of the grid unit. As a result, the grid unit distorts, often resulting in a faulty sealing between the float and seat at the bottom edge of the sleeve.

U.S. Pat. No. 4,623,366 describes a wet/dry canister-type vacuum cleaner that is provided with a plastic grid unit that includes a spherical cup-like main section, an upper annular mounting lip, a short tubular support disposed within the main section with the lower end of the support surrounding a central inlet opening in the latter, and a grid extending across the support at the top thereof and disposed below the mounting lip. The lower end of the support constitutes a seat for a floating ball valve element. An axially extending slot in the support provides a drain for liquid that may be accumulated by the main section at the interior thereof.

The inventions disclosed and taught herein are directed to an improved wet/dry vacuum appliance having a bypass vent system.

BRIEF SUMMARY OF THE INVENTION

Vacuum appliances capable of picking up both wet and dry material are described, the vacuum appliances including an impeller configured to induce liquid into the vacuum appliance, a motor configured to turn the impeller, a restrictor to prevent the liquid from being ingested into the motor impeller, and a bypass vent configured to allow sufficient air to reach the motor impeller chamber in order to keep the motor impeller chamber cool while the restrictor is preventing the liquid from being ingested into the motor impeller. The vacuum appliance may include a drum configured to retain the solid and/or liquid debris and an impeller intake between the impeller and the drum. The restrictor may comprise a float configured to rise with a level of the liquid in the drum and prevent the liquid from entering the impeller intake. The bypass vent may be configured to allow air to bypass the restrictor and/or the drum. The bypass vent may comprise a bypass area of between about 0.01 square inches and about 0.1 square inches. In one non-limiting embodiment, the bypass area is approximately 0.05 square inches.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
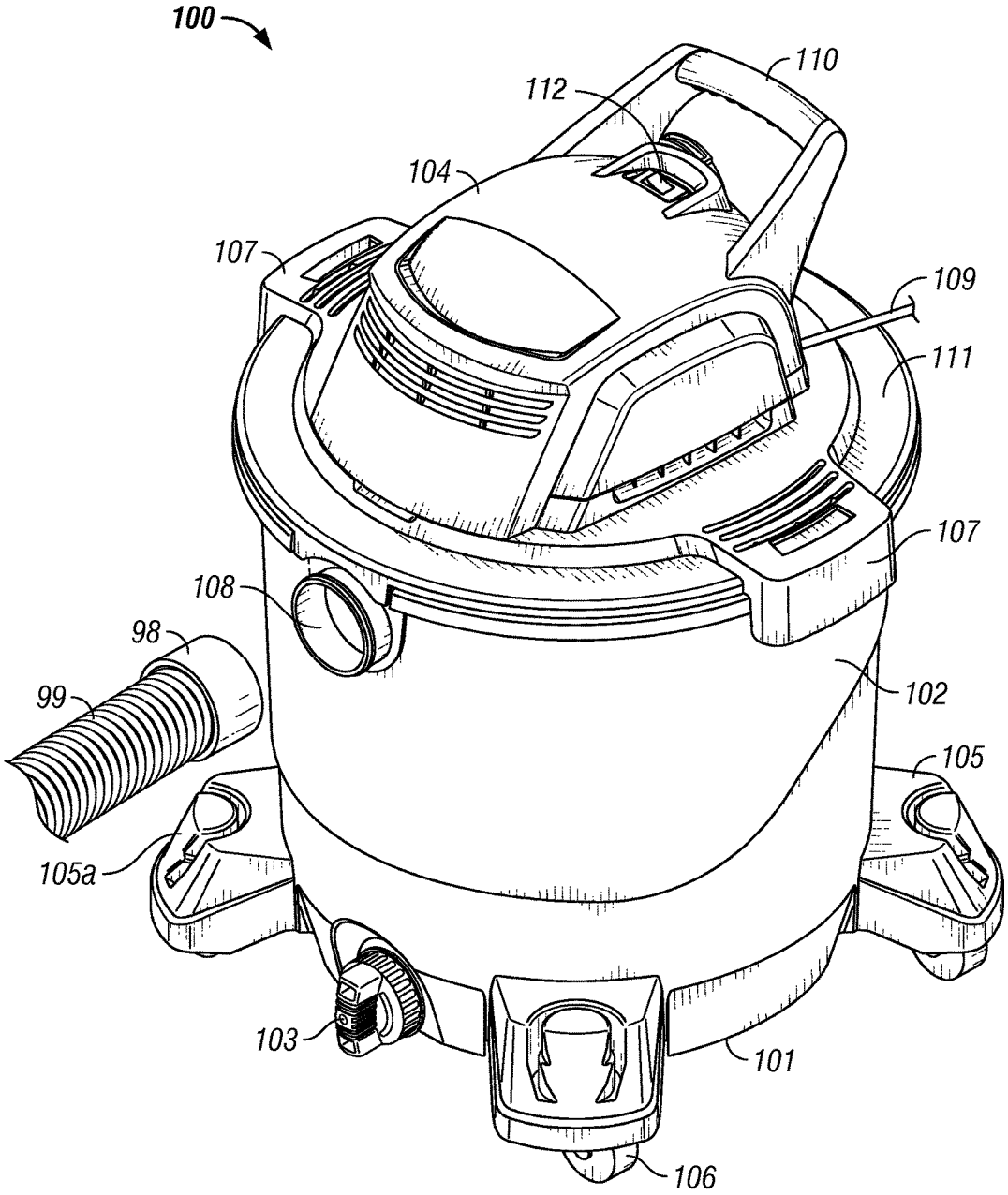
FIG. 1 illustrates a perspective view of a wet/dry vacuum appliance in accordance with one embodiment of the present invention.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a vacuum appliance capable of picking up both wet and dry material, including an impeller configured to induce liquid into the vacuum appliance, a motor configured to turn the impeller, a restrictor to prevent the liquid from being ingested into the impeller, and a bypass vent configured to allow sufficient air to reach the impeller chamber in order to keep the chamber and motor cool while the restrictor is preventing the liquid from being ingested into the impeller. The vacuum appliance may include a drum configured to retain the liquid and an impeller intake between the impeller and the drum. The restrictor may comprise a float configured to rise with a level of the liquid in the drum and prevent the liquid from entering the impeller intake. The bypass vent may be configured to allow airflow to bypass the restrictor, as appropriate.

Figure 2:
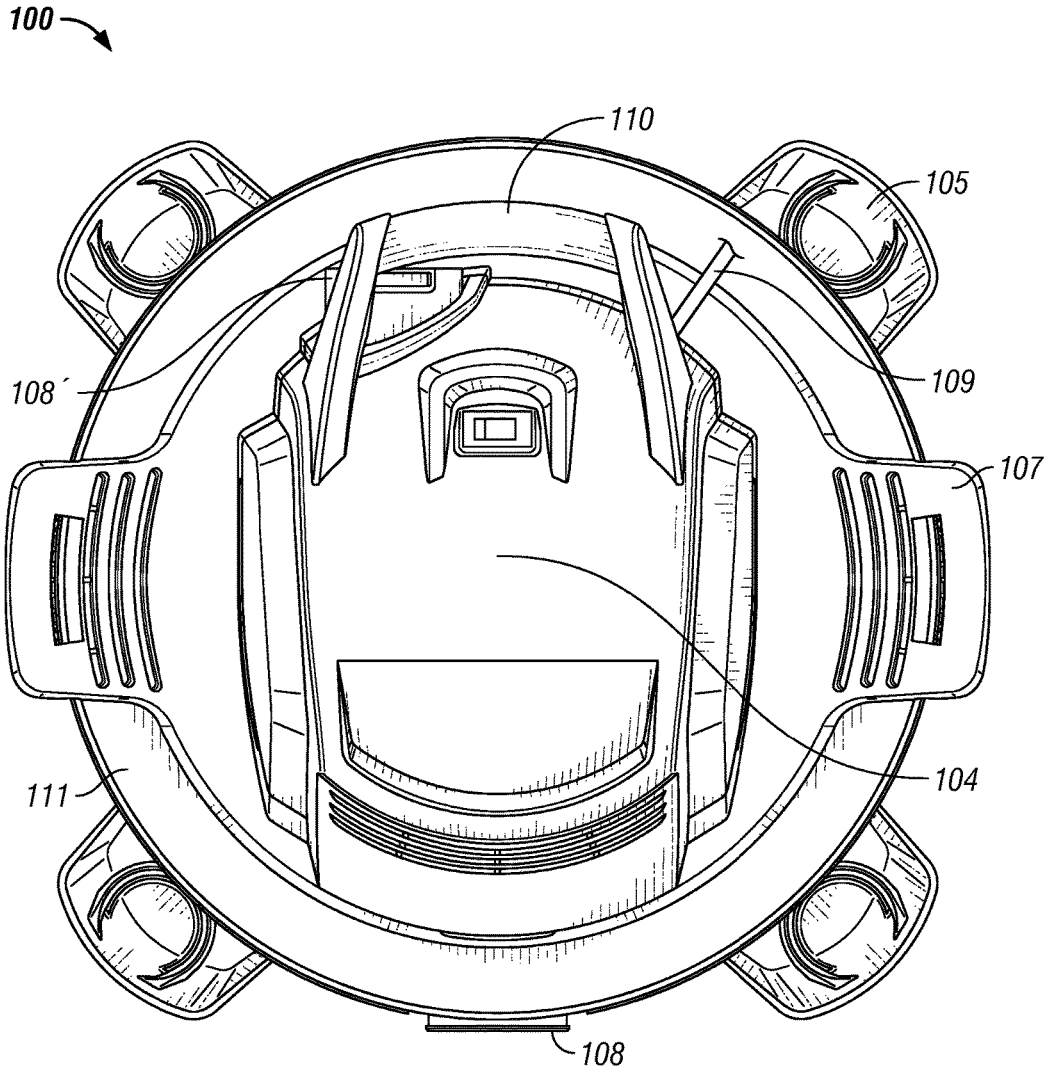
FIG. 2 illustrates a top view of the wet/dry vacuum assembly shown in FIG. 1.
Figure 3:
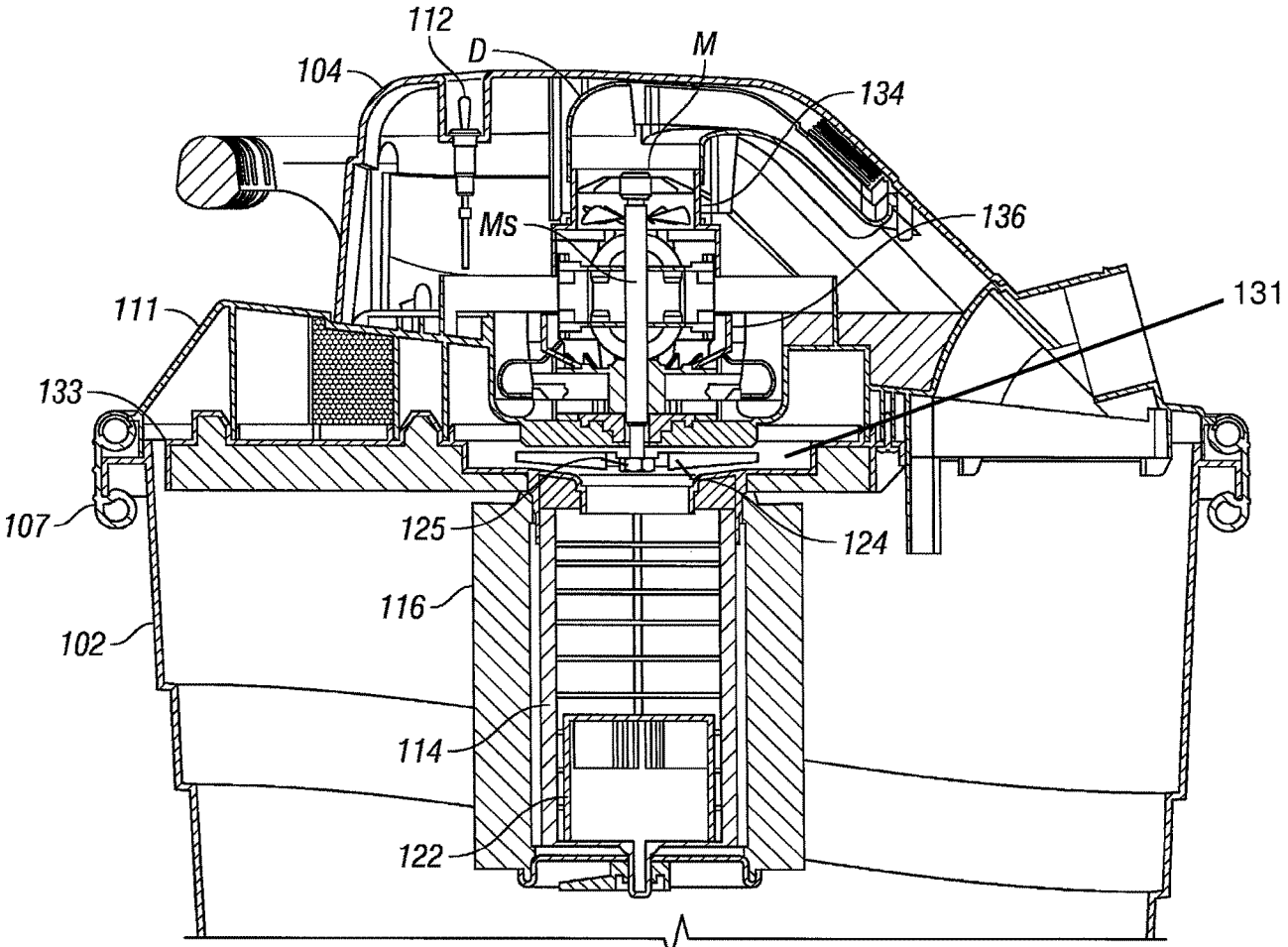
FIG. 3 illustrates a partial sectional view of the embodiment of a wet/dry vacuum assembly shown in FIG. 1, taken along line 3-3.

Turning now to the figures in detail, FIG. 1 is an illustration of a perspective view of an exemplary wet/dry vacuum appliance 100 in accordance with the present disclosure. FIG. 2 illustrates a top view of the vacuum of FIG. 1, while FIG. 3 illustrates a partial cross-sectional view of the wet/dry vacuum appliance of FIG. 1, taken along line 3-3. These figures will be described in conjunction with each other.

As shown in FIG. 1, there is illustrated in perspective view a vacuum appliance 100. In one preferred embodiment of the instant disclosure, vacuum 100 is of the wet/dry variety, i.e., capable of picking up both wet and dry material. Vacuum 100 comprises a collection canister, or drum, 102 having a bottom 101, sides, an open top opposite the bottom, a lid 111, and a powerhead 104 attached to the top face of lid 111, which is releasably secured over the open top of collection canister 102 via handles 107. Affixed to the bottom of drum 102 are a plurality of casters 105 having wheels 106 which allow the vacuum 100 to be pushed or pulled, the casters 105 being optionally shaped to have stepped mounting means **105*a* formed on their top face for accepting vacuum accessories such as vacuum wands and the like for storage when the accessories are not in use. Collection drum 102 may also include a drain outlet and drain plug member 103 at the bottom of the drum, so as to allow for enhanced removal of liquid debris from within the drum itself, such as with a pump accessory as shown in U.S. Design Pat. No. D551,681. Powerhead 104 houses a motor and impeller assembly (not shown) within an impeller chamber, for establishing vacuum pressure within the vacuum 100 during operation. A flexible vacuum hose 99 is configured so that one end can be inserted into an air inlet 108 formed in the front portion of the powerhead 104. In one embodiment, hose 99 is simply friction-fitted into inlet port 108. In other embodiments of the present disclosure, hose 99 may be lock-fit into inlet port 108, or employ a quick-connect/disconnect mechanism in order to obtain a leak-free seal, in accordance with U.S. Pat. Nos. 6,370,730 and 6,115,881, both of which are incorporated herein by reference. The collection drum 102, the lid 111 and the powerhead 104** are preferably made of injection-molded plastic, such as polypropylene or the like, in accordance with conventional practice.

In accordance with conventional designs, the air inlet port 108 is defined in a side wall of the collection drum 102 as shown, or alternatively, may be defined in the lid 111 or within a face of powerhead 104. The powerhead assembly 104 houses a motor (M) and an impeller assembly housed within an impeller chamber, and has defined therein an air exhaust or outlet port 108'. The powerhead assembly 104 is operable to create a suction within the collection drum 102, such that during operation debris and/or liquid is drawn into the collection drum 102 through the hose 99, which is attached to the inlet port 108 via a connection member 98.

From FIGS. 1 and 2 it is apparent that an upper portion of powerhead 104 may be configured to serve as a carrying handle 110 for vacuum 100. Toward the front of handle 110, an on/off switch 112 is disposed, such that switch 112 may be conveniently reached with one's thumb while holding vacuum 100 by handle 110. Power to the vacuum appliance 100 may be via a typical AC power source via power cord 109, or via a battery system, as appropriate.

FIG. 3 is an exploded view of vacuum 100, showing certain internal components thereof not visible in the perspective views of FIGS. 1 and 2. In particular, as shown in FIG. 3, it can be seen that powerhead 104 houses a motor M which receives electrical power from power cord 109 via user actuation of switch 112. On the underside of powerhead 104 is a filter assembly comprising a rigid filter cage 114 and a standard filter 116, such as a cylindrical paper, cloth, polymer, or HEPA-type filter. Filter cage 114 is adapted to be secured on the underside of powerhead 104. The motor M functions to turn an impeller 124 disposed generally above the filter cage 114, such that air is drawn into air inlet port 108, through filter 116 (and cage 114), and out an air outlet port 108'.

As will be described herein in further detail, an airflow path is defined such that, during typical vacuum operation, air is taken in through air inlet port 108, filtered through filter 116 (and cage 114), and finally expelled through the air outlet port 108', leaving vacuumed debris contained within collection drum 102, in accordance with the operation of conventional wet/dry vacuums. The air is propelled through this airflow path by way of the motor M and impeller assembly housed within powerhead 104. The impeller assembly comprises a blower wheel 124 attached to motor M by a nut 125 or similar attachment means suitable for threadably connecting the blower wheel to the Motor via motor shaft $M_s$. As readily evident from FIG. 3, located below the impeller assembly and extending into the drum 102 are the filter cage 114 (housing float 122 within), with a filter 116 fitting snugly over the exterior of filter cage 114. Although in the disclosed embodiment the air inlet port and air outlet port are defined by powerhead 104, it is contemplated that other embodiments may be implemented in which this is not the case. It is sufficient that the powerhead communicate with the air inlet port and the air outlet port during operation, such that powerhead 104 can perform the function of causing air to be drawn in through the air inlet port and expelled out through the air outlet port. As will be appreciated by those of skill in the art, an impeller chamber formed by lid 111 above and a collector assembly 133 below surrounds the impeller 124, and its configuration is such that the rotation of fins or blades of the impeller 124 causes the vacuum pressure to be created within vacuum 100.

As indicated above, a float 122, which may take many forms such as a ball or a cylinder, is disposed within filter cage 114. Float 122 rises automatically within cage 114 to restrict the flow of air through vacuum 100 when liquid in the drum, 102 reaches a predetermined level. A plurality of fins (not shown) may optionally be formed within cage 114 to serve as guides to keep the float 122 centrally disposed within cage itself.

In the presently disclosed embodiment of the invention, lower motor frame 136 fits into the bottom face of lid 111, creating an annular seal designated with reference numerals 138. The assembly consisting of motor M, lid 111, and motor frames 134 and 136 may be attached to bottom face 132 of powerhead 104 with screws 140. An impeller intake aperture 142 defined by powerhead bottom 132 provides a path for the flow of air to impeller 128 to be expelled through output port 130. To form a seal between collector member 133 and powerhead bottom 132, an annular ring seal 144 is formed in bottom 132, which interlocks with a corresponding annular groove in collector member 133, in a tongue-and-groove fashion.

As discussed above, during typical vacuum operation, float 122 rises automatically within cage 114 to restrict the flow of air through vacuum 100 when liquid in collection drum 102 reaches a predetermined level. In its raised position, the float 122 may partially seal the intake aperture 142 in the powerhead bottom 132. In this manner, the float 122 acts as a restrictor, preventing liquid from being sucked, or ingested, into the impeller 124, and/or the impeller chamber 131. One can appreciate that the float 122 may take forms other than cylindrical.

In further accordance with the present disclosure, when the airflow path is blocked or otherwise limited, less airflow is available to cool the impeller 124, impeller chamber 131, and motor (M). Additionally, when the airflow path is blocked or otherwise limited, significant suction may be created within the vacuum 100. To alleviate one or both issues, as well as other potential issues, the present invention preferably includes a bypass vent 200 somewhere along the airflow path before, or upstream of, the impeller 124 to allow sufficient airflow to cool the motor M, impeller 124, and impeller chamber 131 even when liquid in drum 102 reaches the predetermined level.

The bypass vent 200 of the present invention provides a small, controlled amount of fresh ambient air, or bypass air, to enter the impeller chamber 131 to keep it cool. At the same time, the bypass vent 200 of the present invention keeps the airflow to a minimum in order to keep the vacuum pressure generated inside the drum 102 to a level that will not pull liquid into the vacuum drum 102 when picking up mixtures of air and liquid.

Figure 4:
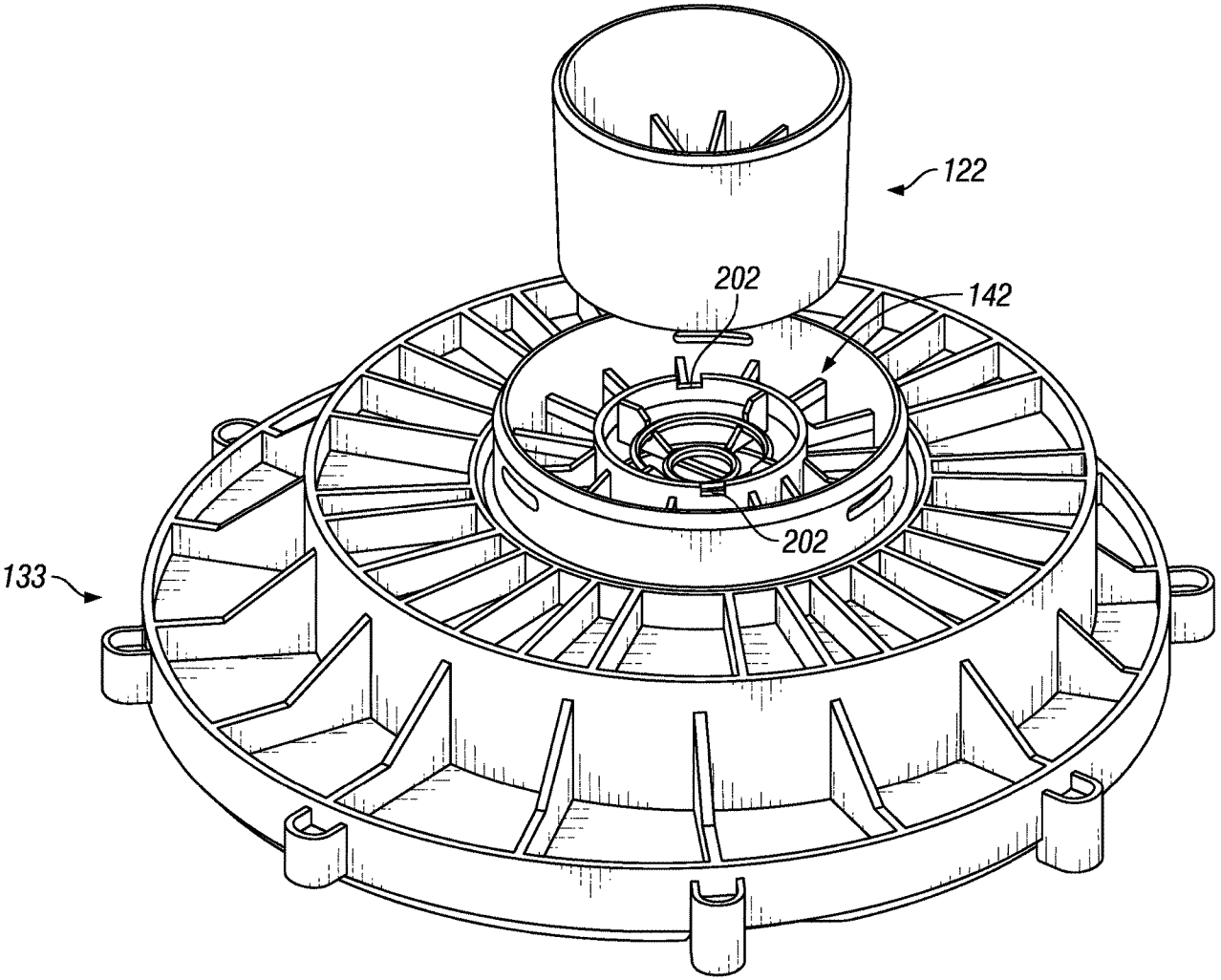
FIG. 4 illustrates a perspective view of a chamber region of a vacuum utilizing certain aspects of the present inventions.

The bypass vent is preferably tuned and located to allow enough cooling air to keep the impeller chamber 131 and motor M cool while, at the same time, prevent intake of liquid. The reduced vacuum pressure, with the float in the sealed position, must be less than that needed to lift the water from the source up to the intake of the vacuum, which typically would be greater than 10 inches of water head. In one embodiment, with a blocked suction pressure of approximately 40-55 inches of water (1.4-2.0 pounds per square inch, psi), the bypass vent 200 preferably provides a bypass area of about 0.05 square inches located at the interface between the float 122 and the impeller's air intake 142. In one embodiment, referring to FIG. 4, this bypass area is provided by two bypass notches 202, each of which providing a bypass area of about 0.025 square inches in size in the rim of the impeller intake 142. However, any number of notches, or holes, can be used, so long as the final size is approximately 0.05 square inches, and wherein the blocked suction pressure is approximately 40-55 inches of water.

It should be understood that different opening sizes for other peak vacuum pressures would be required. For example, in alternative embodiments, the bypass area may be about 0.01 square inches, about 0.025 square inches, about 0.075 square inches, or about 0.1 square inches. Due to manufacturing tolerances, as well as other considerations, the bypass area may be between about 0.01 square inches and about 0.025 square inches, between about 0.025 square inches and about 0.05 square inches, between about 0.03 square inches and about 0.07 square inches, between about 0.05 square inches and about 0.075 square inches, or between about 0.07 square inches and about 0.1 square inches.

Furthermore, as will be discussed in greater detail below, the bypass vent 200 may be located in other places, such as a hole near the top of the vacuum 100. Additionally, in alternative embodiments, the notches are provided in the drum 102, the float 122, the impeller intake 142, and in an insert or grille between the impeller 124 and the drum 102.

In accordance with one embodiment of the present disclosure, the bypass vent 200 is significantly smaller than the main hose air input port, or inlet, 108. More specifically, the bypass vent 200 is preferably tuned to allow a consistent amount of air to bypass the seal between the float 122 and the intake aperture 142. This bypass, or leakage, air keeps the air temperature inside the impeller chamber 131 well below the maximum operating temperature of the motor M and other vacuum components, such as the motor's lower frame. At the same time, this bypass air is small enough that the vacuum pressure generated inside the drum 102 is low and will no longer pick up liquid, thus keeping liquid from ever entering the impeller chamber 131. Thus, by hitting this critical region, the bypass vent 200 allows the vacuum 100 to run long term with the float 122 in the raised position without overheating the motor M and without allowing further liquid to be pulled into the vacuum 100.

Figure 5:
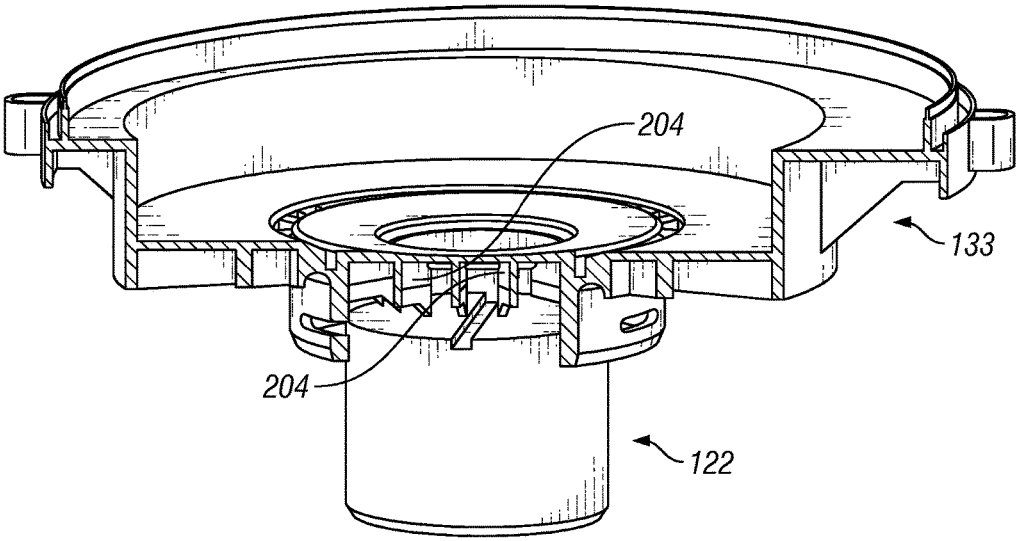
FIG. 5 illustrates a cut-away perspective view of a chamber member of a vacuum utilizing certain aspects of the present inventions.

Thus, the bypass vent 200 provides a controlled area of air leakage into the impeller chamber 131 to introduce fresh cooling air while, at the same time, choking off or substantially reducing the airflow to a flow rate sufficient to minimize the vacuum pressure developed inside the drum 102, and thus stop the inflow of liquid into the drum 102 for air/liquid mixtures. This controlled air leakage, or bypass air, can be provided at the interface between the float 122 and the impeller inlet 142, on the inlet 142 itself, or in the float 122 itself, or a combination thereof. As discussed above, the bypass vent 200 may be specific holes, notches, or slits in either the float 122 or the rim of the impeller intake 142. For example, three or more short ribs, approximately 0.010" or smaller, may be raised on the top of the float 122, or some other standoff feature may be built in to the top of the float 122. Alternatively, as shown in FIG. 5, the ribs 204, or some other standoff feature, may be built in to the impeller intake 142.

Figure 6:
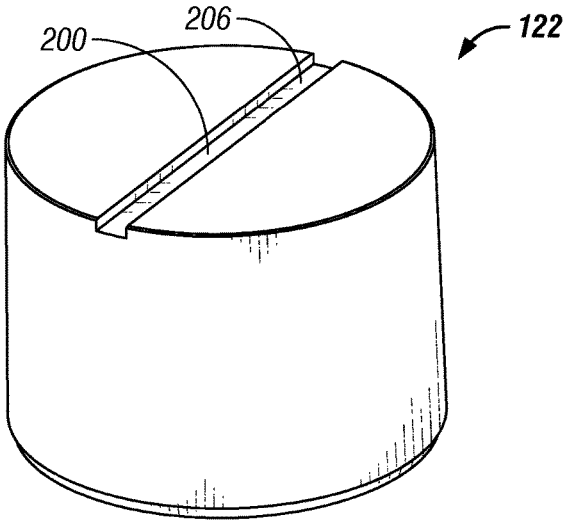
FIG. 6 illustrates a perspective view of a typical float of a vacuum utilizing certain aspects of the present inventions.
Figure 7:
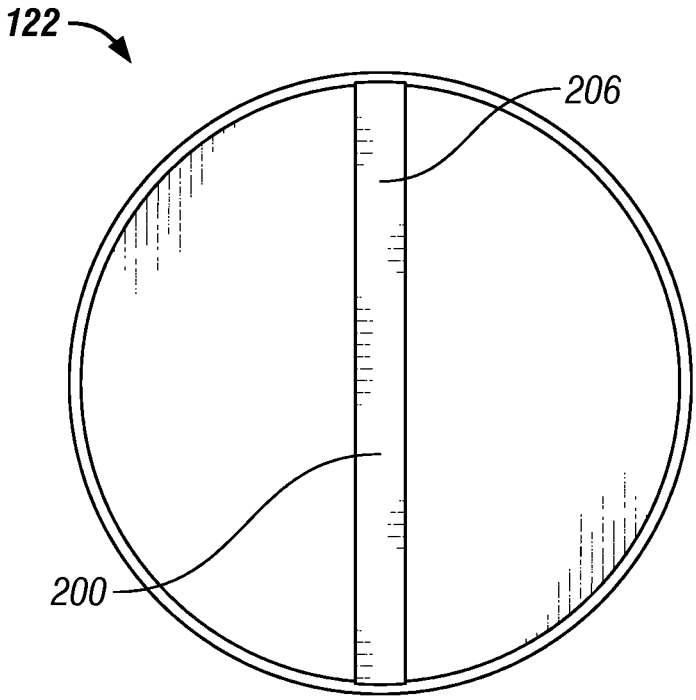
FIG. 7 illustrates a top plan view of the float of FIG. 6, taken along line 7-7.
Figure 8:
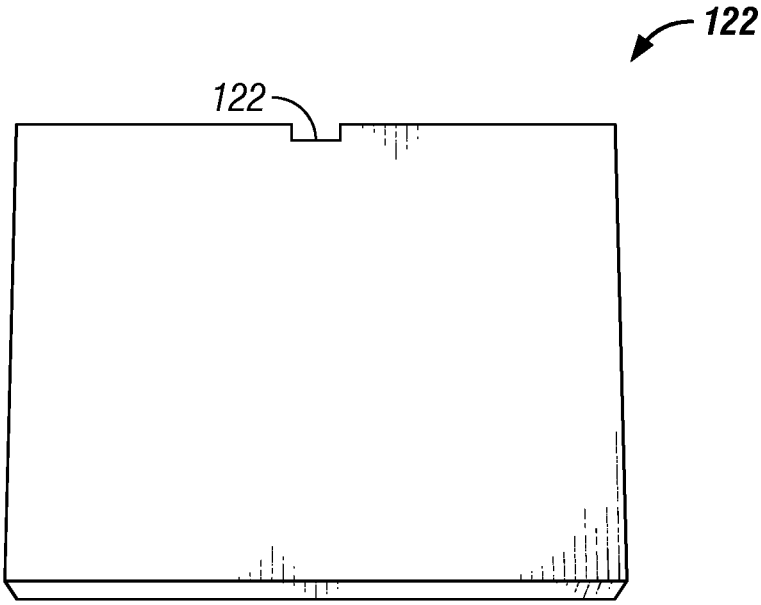
FIG. 8 illustrates a side elevation view of the float of FIG. 6, taken along line 8-8.

In still another embodiment of the present disclosure, and referring to the perspective view of float 122 shown in FIG. 6, the bypass vent 200 may be embodied as one or more grooves 206 formed on the top surface of the float 122, so as to provide the bypass airflow path. In FIG. 7 and FIG. 8, cross-sectional views of float 122 along lines 7-7 and 8-8, respectively, of FIG. 6, show that the groove (or grooves) 206 may be straight, extending from one edge of the float to an opposite edge. Alternatively, and equally acceptable, the groove or grooves 206 acting as bypass vents may be diagonal, crossing, curved, and/or spiral, as appropriate.

Figure 9A:
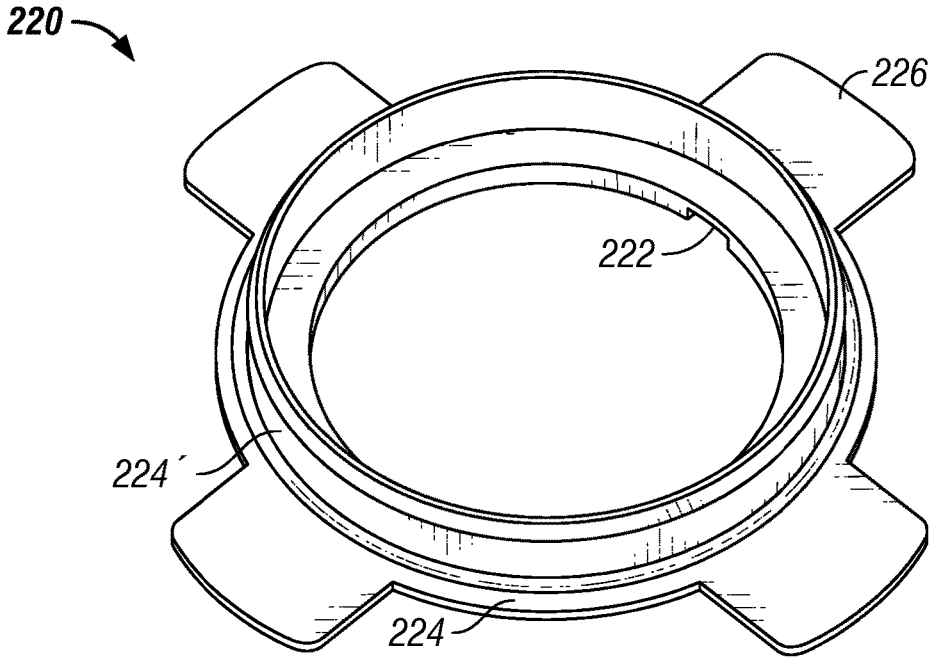
FIG. 9A illustrates a perspective view of an insert of a vacuum utilizing certain aspects of the present inventions.
Figure 9B:
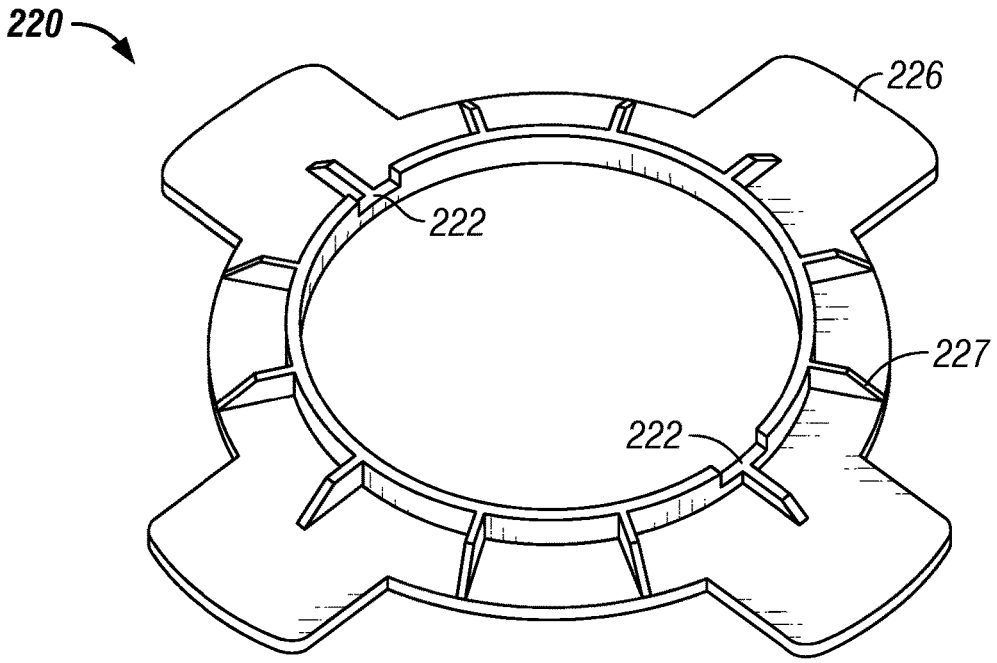
FIG. 9B illustrates a perspective view of the opposite face of the insert of FIG. 9A.
Figure 10A:
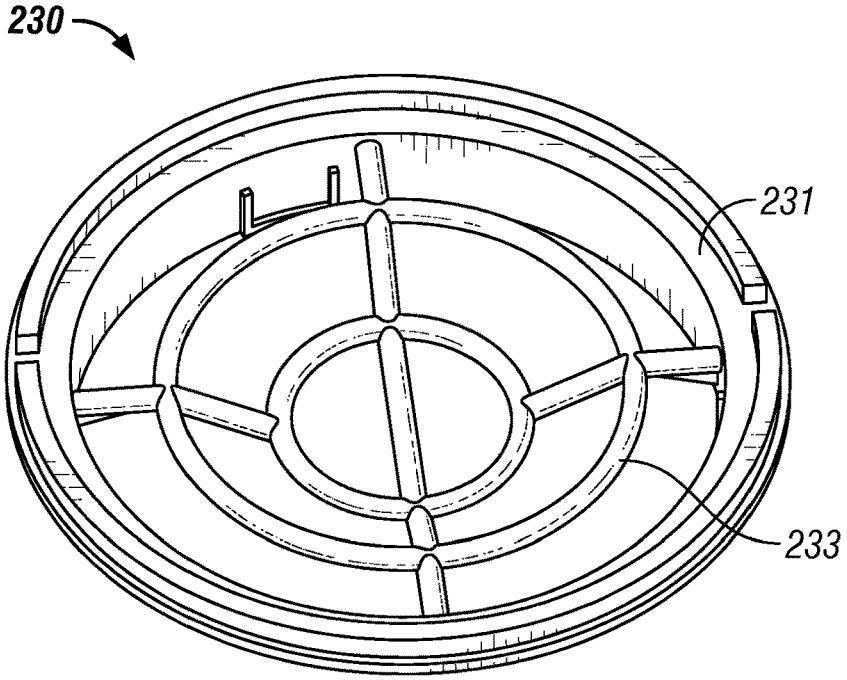
FIG. 10A illustrates a perspective view of the top face of an insert with a grille for use with a vacuum utilizing certain aspects of the present invention.
Figure 10B:
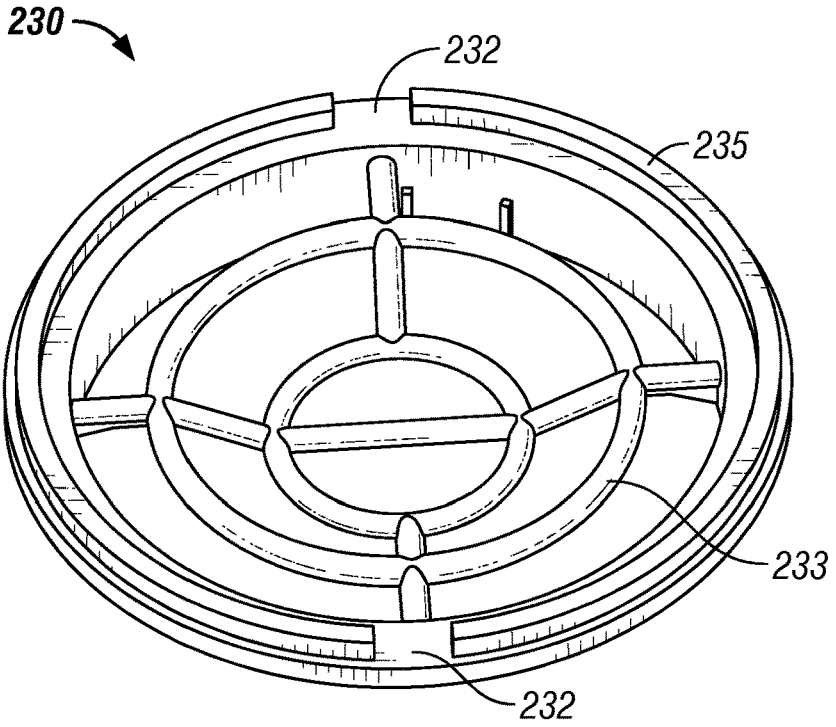
FIG. 10B illustrates another perspective view of the insert with a grille of FIG. 10A, rotated 90° clockwise.
Figure 11A:
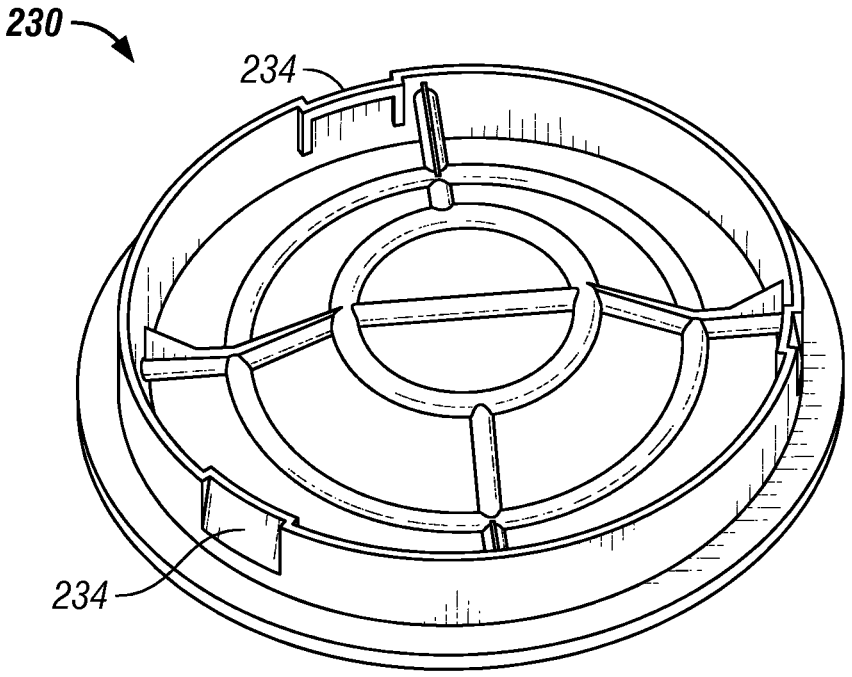
FIG. 11A illustrates a perspective view of the bottom, opposite face of the insert with a grille of FIG. 10A.
Figure 11B:
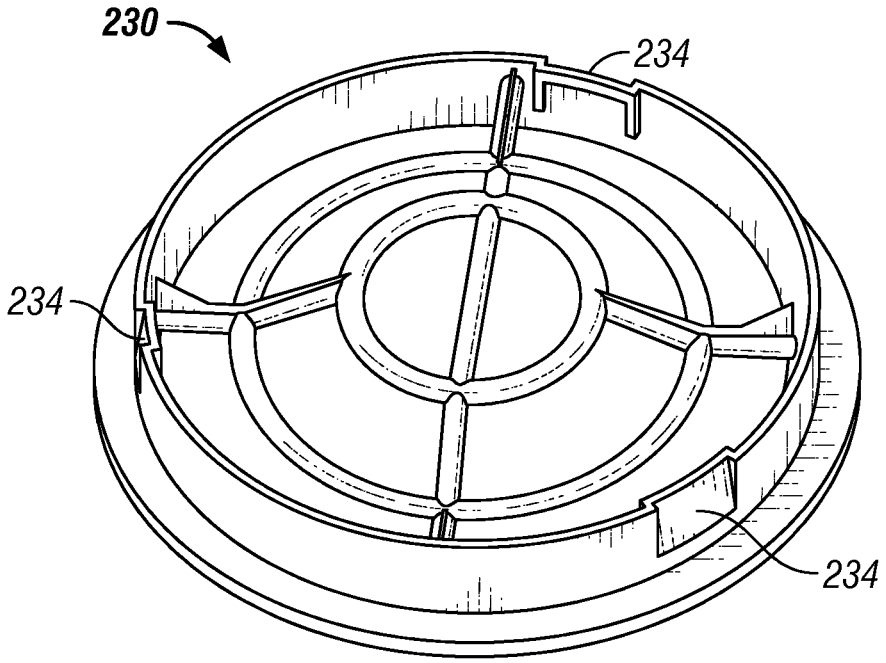
FIG. 11B illustrates a further perspective view of the bottom face of the insert with a grille of FIG. 11A, rotated 90° clockwise.

Alternatively, referring to FIG. 9A and FIG. 9B, illustrating separate facial views of an alternative bypass assembly 220 of the present disclosure, the bypass vent 200 may be designed into a separate annular insert 220 that fits into the impeller intake aperture 142. The insert 220 may have one or more bypass notches 222 formed in the rim of the assembly 220 that interfaces with the top of the float 122. A wedge-shaped surface, such as created by formed fins 227, may provide for a tight fit of the bypass assembly 220 into the impeller intake aperture 142, thereby forming a seal. Alternatively, or additionally, one or more o-rings 224, 224' may be used with the insert, circumscribing the exterior face of the assembly 220 (in the case of O-ring 224), and/or the interior face of the assembly (in the case of O-ring 224'), so as to provide the seal, or enhance the seal as appropriate. As shown in FIGS. 9A, 9B, the insert 220 may be further include a plurality (two or more) of tabs 226 extending outwardly from the outer edge or rim of the insert 220, and which act to hold the insert 220 in place by sandwiching the insert under the filter cage 114 when assembled.

Figure 12:
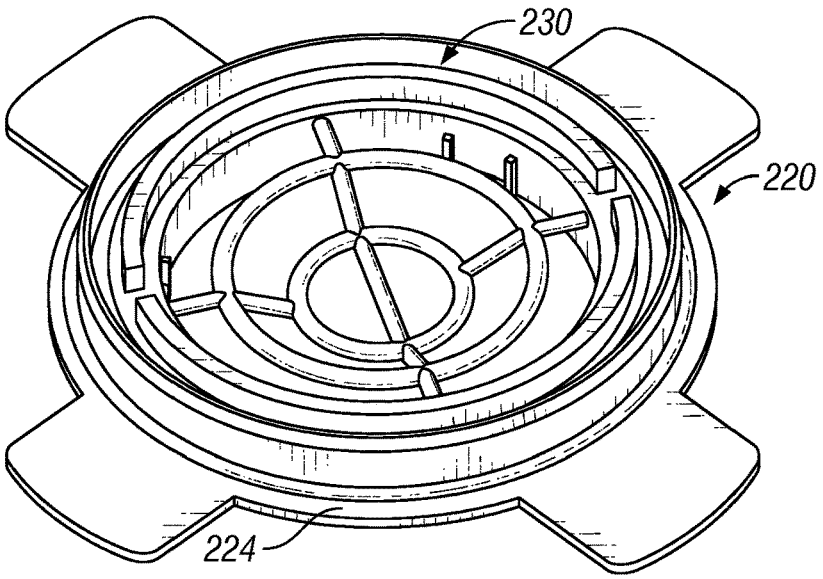
FIG. 12 illustrates a perspective view of a subassembly comprising the insert of FIG. 9 and FIG. 10.
Figure 13:
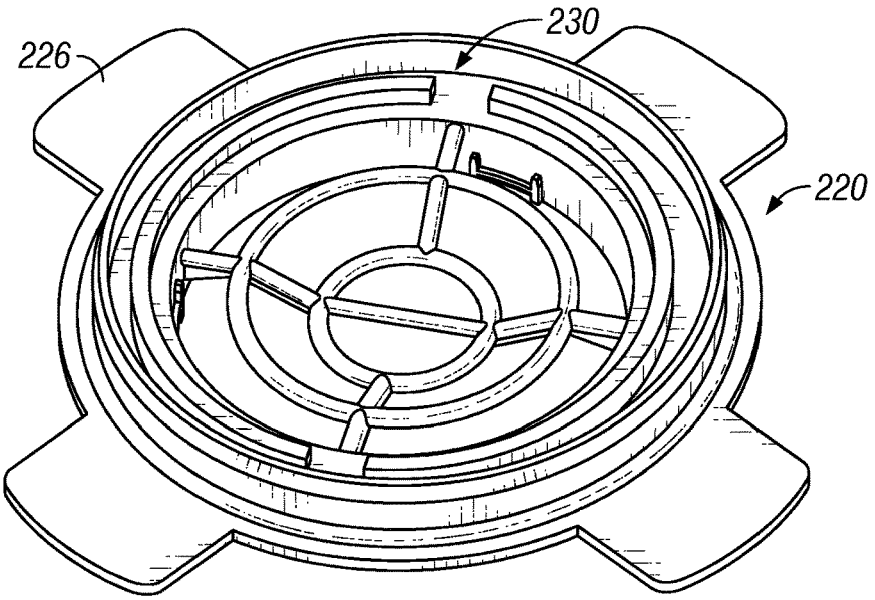
FIG. 13 illustrates a further perspective view of the subassembly of FIG. 17, rotated 90° clockwise.
Figure 14:
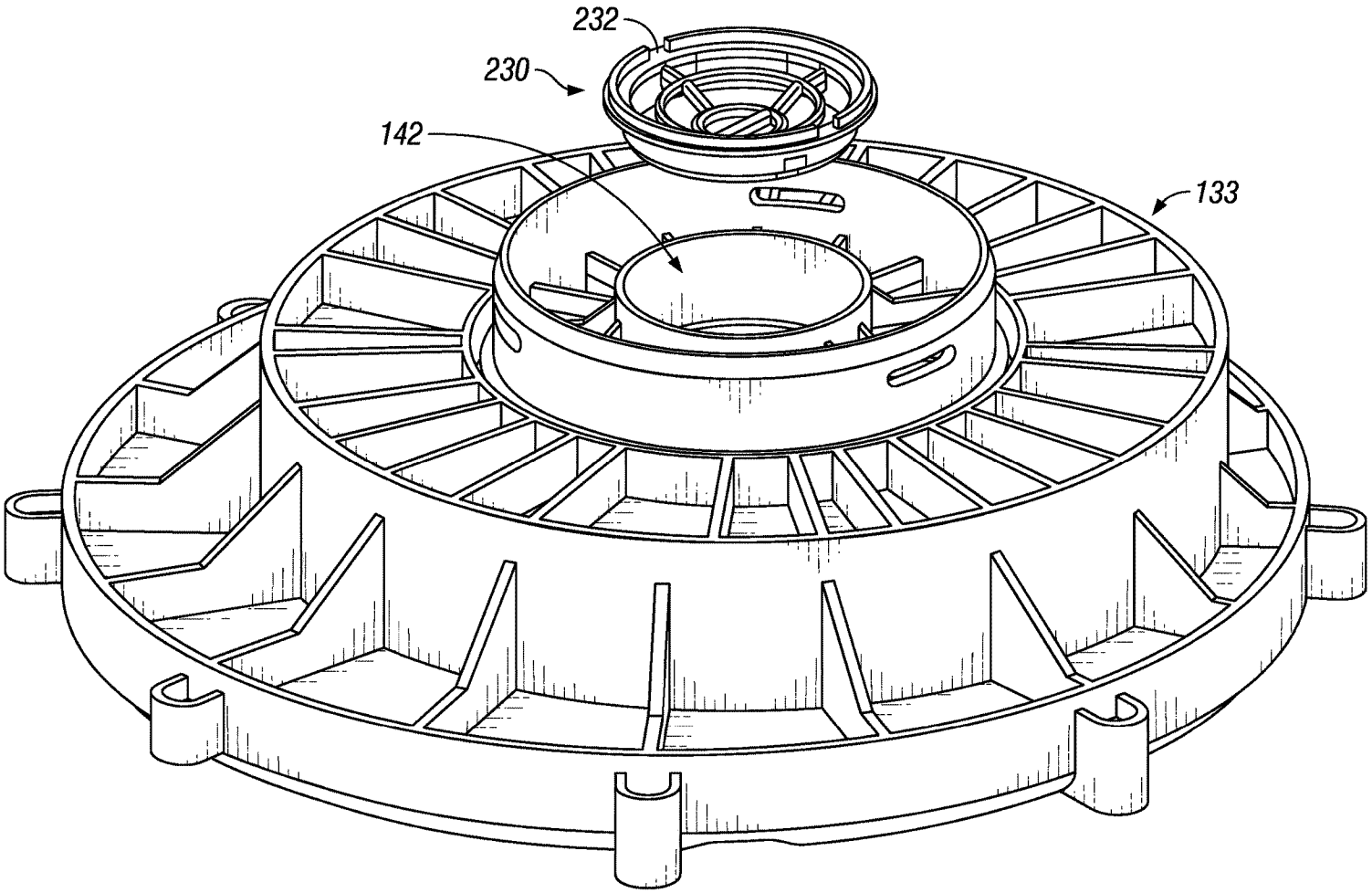
FIG. 14 illustrates a perspective exploded view of the assembly of a grille assembly of the present disclosure and the bottom face of a collector assembly of a wet/dry vacuum appliance.
Figure 15:
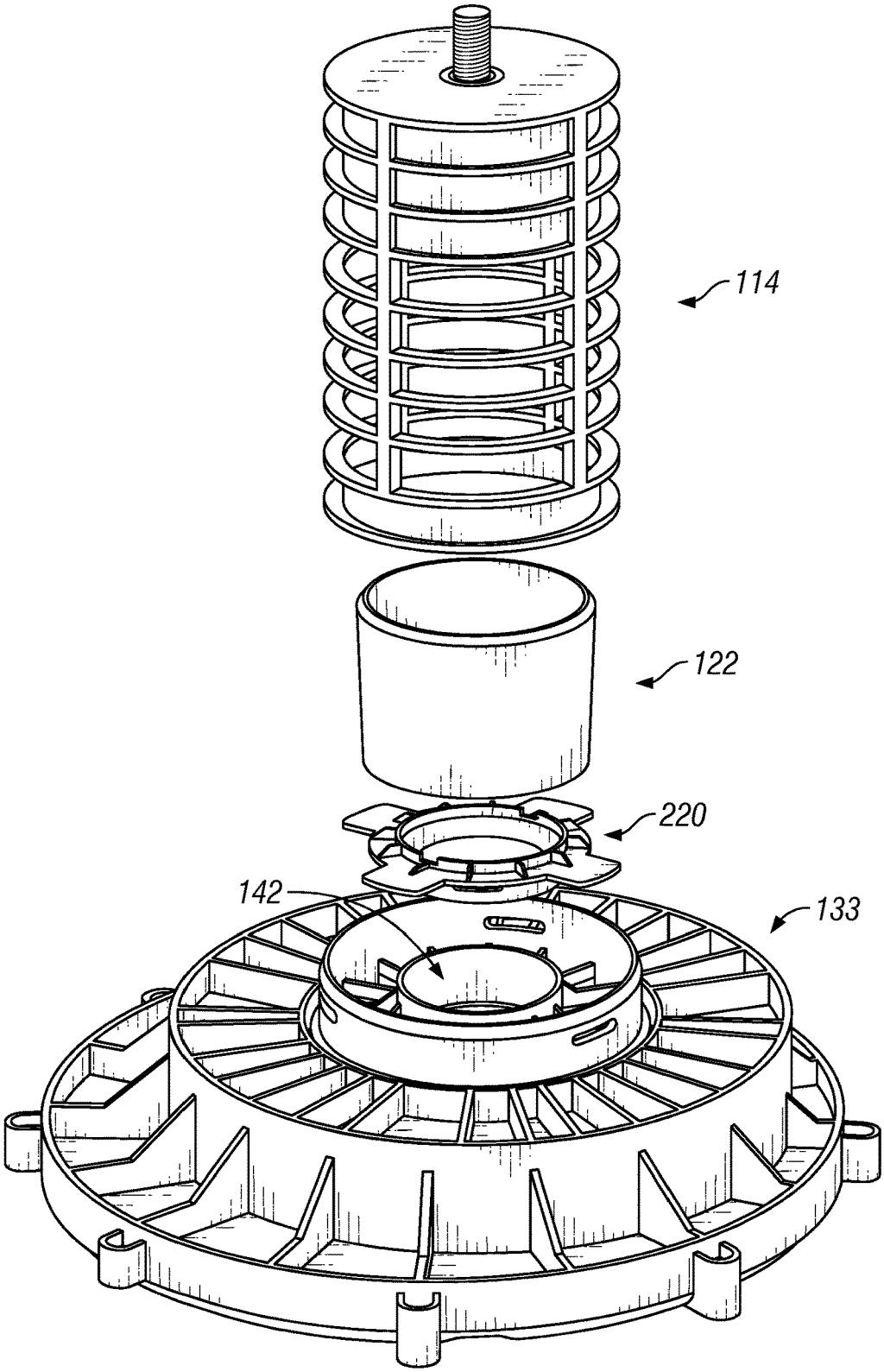
FIG. 15 illustrates a perspective exploded view of a further embodiment of the present disclosure.

Referring now to FIG. 10A, FIG. 10B, FIG. 11A, FIG. 11B, FIG. 12 and FIG. 13 in relation, the a further, optional bypass assembly 230 is illustrated, which may be used alone, or in association with bypass assembly insert 220, as appropriate. Assembly 230 is an annular assembly having an edge or rim 231 within inside and outside faces, and a filtering grate, or grille, 233 extending across the inner face of rim 231 of the assembly 230, the grille acting as a last-chance barrier to prevent medium or large debris particles from entering the collector, or impeller, chamber 131. The assembly 230 may have one or more bypass notches 232 formed into a top face 235 of the rim, the notches 232 interfacing with the top of the float 122 when the vacuum is fully assembled. The assembly 230 may be held in place by metal barbs 234 formed or inserted into the outer face of rim 231, and/or by wings or tabs which allow the assembly 230 to be trapped under the filter cage 114, similar to the bypass assembly insert 220 described above. FIGS. 12 and 13 illustrate a further, optional assembly of the present disclosure, wherein before insertion into the vacuum assembly in the impeller intake opening, intermediate between the filter cage and associated float and the impeller intake assembly, bypass vent assemblies 220 and 230 are combined, with the annular grate assembly 230 fitting within the interior region of the rim of bypass assembly 220, and resting on a surface formed on the interior face of the rim of assembly 220. In such a configuration, it is important that the bypass notches 222 and 232 are aligned, so as to allow for sufficient air to reach the impeller chamber and keep the impeller chamber cool. FIGS. 14 and 15 illustrate exploded views of a filter cage 114, float 122, the inserts 230 and 220 (respectively), and an exemplary collector member 133, and their assembly into the impeller intake opening 142 on the bottom surface of the lid of a vacuum cleaner.

Other and further embodiments utilizing one or more aspects of the inventions described above can be devised without departing from the spirit of Applicant's invention. In one embodiment, the bypass vent 200 provides airflow directly from the outside of the vacuum 100. For example, a tube may be used to connect the intake port 142 of the impeller chamber 131 to the outside of the vacuum 100. Thus, the bypass vent 200 may allow the impeller to induce airflow to bypass the float 122, the drum 102, and/or the impeller intake 142. In alternative embodiments, the bypass vent 200 may comprise one notch, three notches, four notches, and/or five or more notches. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

The invention claimed is:

1. A vacuum appliance capable of picking up both wet and dry material, the appliance comprising:

a powerhead comprising— an impeller configured to induce a liquid into the vacuum appliance, an impeller chamber surrounding the impeller, and an impeller intake defining a path for air flow to impeller;

a float assembly comprising— a cage, and a float disposed within the cage, the float being configured to form an interface with the impeller intake to prevent the liquid from being ingested into the impeller chamber; and a bypass vent in the interface between the float and the impeller intake.

2. The vacuum appliance as set forth in claim 1, further including a drum configured to retain the liquid.

3. The vacuum appliance as set forth in claim 2, wherein the float is configured to rise with a level of the liquid in the drum and block the liquid from entering the impeller intake.

4. The vacuum appliance as set forth in claim 1, wherein the bypass vent is configured to allow airflow to flow through the interface.

5. The vacuum appliance as set forth in claim 1, wherein the bypass vent is configured to allow the impeller to induce airflow through the interface.

6. The vacuum appliance as set forth in claim 1, wherein the bypass vent comprises a bypass area to introduce cooling air while, at the same time, stopping the inflow of liquid into the vacuum appliance.

7. The vacuum appliance as set forth in claim 1, wherein the bypass vent comprises a plurality of bypass areas to introduce cooling air while, at the same time, stopping the inflow of liquid into the vacuum appliance.

8. The vacuum appliance as set forth in claim 1, wherein the bypass vent comprises a notch formed in the impeller intake.

9. The vacuum appliance as set forth in claim 1, wherein the bypass vent comprises a notch formed in an insert fitted to the impeller intake.

10. The vacuum appliance as set forth in claim 1, wherein the bypass vent comprises a notch formed in a rim of an insert fitted to the impeller intake.

11. The vacuum appliance as set forth in claim 1, wherein the bypass vent provides a controlled area of air leakage into the impeller chamber to introduce cooling air while, at the same time, stopping the inflow of liquid into the vacuum appliance.

12. The vacuum appliance as set forth in claim 1, wherein the bypass vent is configured to reduce vacuum pressure within the appliance to less than that needed to lift the liquid into the vacuum appliance.

13. The vacuum appliance as set forth in claim 1, wherein the bypass vent comprises a groove formed in the float.

14. The vacuum appliance as set forth in claim 1, wherein the bypass vent comprises a groove formed in a top surface of the float.

15. The vacuum appliance as set forth in claim 1, wherein the bypass vent comprises a rib formed in the float.

16. The vacuum appliance as set forth in claim 1, wherein the bypass vent comprises a rib formed in a top surface of the float.

17. The vacuum appliance as set forth in claim 1, wherein the bypass vent comprises a rib formed in the impeller intake.

18. A vacuum appliance capable of picking up both wet and dry material, the appliance comprising:

a drum;

a powerhead atop the drum, the powerhead comprising— a motor, an impeller driven by the motor and configured to induce a liquid into the drum, an impeller chamber surrounding the impeller, and an impeller intake defining a path for air flow to impeller;

a filter assembly between the drum and the powerhead, the filter assembly comprising— a filter cage, a float disposed within the filter cage, and a filter disposed around the filter cage, the filter assembly being adapted to be secured to the underside of the powerhead such that the float is configured to form an interface with the impeller intake to prevent the liquid from being ingested into the impeller chamber; and a bypass vent in the interface between the float and the impeller intake where the float meets the impeller intake, the vent configured to allow cooling air to reach the impeller chamber while the float is simultaneously preventing the liquid from being ingested into the impeller chamber.

19. The vacuum appliance as set forth in claim 18, wherein the bypass vent comprises a groove formed in a top surface of the float.

20. The vacuum appliance as set forth in claim 18, wherein the bypass vent comprises a plurality of notches formed in the impeller intake.

21. A vacuum appliance capable of picking up both wet and dry material, the appliance comprising:

a drum;

a powerhead atop the drum, the powerhead comprising— a motor, an impeller driven by the motor and configured to induce a liquid into the drum, an impeller chamber surrounding the impeller, and an impeller intake defining a path for air flow to impeller; and a filter assembly between the drum and the powerhead, the filter assembly comprising— a filter cage, a float disposed within the filter cage, and a filter disposed around the filter cage, the filter assembly being adapted to be secured to the underside of the powerhead such that the float is configured to form an interface with the impeller intake, the interface having a bypass vent therein, thereby preventing the liquid from being ingested into the impeller chamber while simultaneously allowing cooling air to reach the impeller chamber.

22. The vacuum appliance as set forth in claim 21, wherein the bypass vent comprises a groove formed in a top surface of the float.

23. The vacuum appliance as set forth in claim 21, wherein the bypass vent comprises a plurality of notches formed in the impeller intake.

24. A vacuum appliance capable of picking up both wet and dry material, the appliance comprising:

a powerhead comprising— an impeller configured to induce a liquid into the vacuum appliance, an impeller chamber surrounding the impeller, and an impeller intake defining a path for air flow to impeller;

a float assembly comprising— a cage, and a float disposed within the cage, the float forming an interface with the impeller intake to prevent the liquid from being ingested into the impeller chamber; and a bypass vent in the interface between the float and the impeller intake.

25. The vacuum appliance as set forth in claim 24, further including a drum configured to retain the liquid.

26. The vacuum appliance as set forth in claim 25, wherein the float is configured to rise with a level of the liquid in the drum and block the liquid from entering the impeller intake.

27. The vacuum appliance as set forth in claim 24, wherein the bypass vent is configured to allow airflow to flow through the interface.

28. The vacuum appliance as set forth in claim 24, wherein the bypass vent is configured to allow the impeller to induce airflow through the interface.

29. The vacuum appliance as set forth in claim 24, wherein the bypass vent comprises a bypass area to introduce cooling air while, at the same time, stopping the inflow of liquid into the vacuum appliance.

30. The vacuum appliance as set forth in claim 24, wherein the bypass vent comprises a plurality of bypass areas to introduce cooling air while, at the same time, stopping the inflow of liquid into the vacuum appliance.

31. The vacuum appliance as set forth in claim 24, wherein the bypass vent comprises a notch formed in the impeller intake.

32. The vacuum appliance as set forth in claim 24, wherein the bypass vent comprises a notch formed in an insert fitted to the impeller intake.

33. The vacuum appliance as set forth in claim 24, wherein the bypass vent comprises a notch formed in a rim of an insert fitted to the impeller intake.

34. The vacuum appliance as set forth in claim 24, wherein the bypass vent provides a controlled area of air leakage into the impeller chamber to introduce cooling air while, at the same time, stopping the inflow of liquid into the vacuum appliance.

35. The vacuum appliance as set forth in claim 24, wherein the bypass vent is configured to reduce vacuum pressure within the appliance to less than that needed to lift the liquid into the vacuum appliance.

36. The vacuum appliance as set forth in claim 24, wherein the bypass vent comprises a groove formed in the float.

37. The vacuum appliance as set forth in claim 24, wherein the bypass vent comprises a groove formed in a top surface of the float.

38. The vacuum appliance as set forth in claim 24, wherein the bypass vent comprises a rib formed in the float.

39. The vacuum appliance as set forth in claim 24, wherein the bypass vent comprises a rib formed in a top surface of the float.

40. The vacuum appliance as set forth in claim 24, wherein the bypass vent comprises a rib formed in the impeller intake.

41. A vacuum appliance capable of picking up both wet and dry material, the appliance comprising:

a drum;

a powerhead atop the drum, the powerhead comprising— a motor, an impeller driven by the motor and configured to induce a liquid into the drum, an impeller chamber surrounding the impeller, and an impeller intake defining a path for air flow to impeller;

a filter assembly between the drum and the powerhead, the filter assembly comprising— a filter cage, a float disposed within the filter cage, and a filter disposed around the filter cage, the filter assembly being adapted to be secured to the underside of the powerhead such that the float forms an interface with the impeller intake to prevent the liquid from being ingested into the impeller chamber; and a bypass vent in the interface between the float and the impeller intake where the float meets the impeller intake, the vent configured to allow cooling air to reach the impeller chamber while the float is simultaneously preventing the liquid from being ingested into the impeller chamber.

42. The vacuum appliance as set forth in claim 41, wherein the bypass vent comprises a groove formed in a top surface of the float.

43. The vacuum appliance as set forth in claim 41, wherein the bypass vent comprises a plurality of notches formed in the impeller intake.

* * * * *